US008988175B2

(12) United States Patent
Cieply et al.

(10) Patent No.: US 8,988,175 B2
(45) Date of Patent: Mar. 24, 2015

(54) OVERRIDE DEVICE FOR A CIRCUIT BREAKER AND METHODS OF OPERATING CIRCUIT BREAKER

(75) Inventors: Przemyslaw Eugeniusz Cieply, Bielsko-Biala (PL); Wolfgang Meyer-Haack, Neumünster (DE); Jacek Marian Urbanowicz, Bielsko-Biala (PL); Rafal Marek Mrotek, Bielsko-Biala (PL); Jacek Stanislaw Mrowiec, Bielsko-Biala (PL)

(73) Assignee: General Electric Company, Schenectady, NY (US)

( * ) Notice: Subject to any disclaimer, the term of this patent is extended or adjusted under 35 U.S.C. 154(b) by 472 days.

(21) Appl. No.: 13/359,079

(22) Filed: Jan. 26, 2012

(65) Prior Publication Data

US 2013/0192965 A1 Aug. 1, 2013

(51) Int. Cl.

| | |
|---|---|
| ***H01H 9/00*** | (2006.01) |
| ***H01H 3/02*** | (2006.01) |
| ***H01H 71/68*** | (2006.01) |
| ***H01H 73/04*** | (2006.01) |
| ***H01H 89/06*** | (2006.01) |

(52) U.S. Cl.

CPC ..... *H01H 3/02* (2013.01); *H01H 71/68* (2013.01); *H01H 73/045* (2013.01); *H01H 89/06* (2013.01)

USPC ..... 335/175; 335/16

(58) Field of Classification Search

CPC ... H01H 3/3015; H01H 71/505; H01H 71/52; H01H 9/20; H01H 3/42; H01H 9/24

USPC ..... 335/175

See application file for complete search history.

(56) References Cited

U.S. PATENT DOCUMENTS

| | | | | | |
|---|---|---|---|---|---|
| 4,114,123 | A | * | 9/1978 | Grenier | 335/42 |
| 4,298,852 | A | | 11/1981 | Maier et al. | |
| 4,968,863 | A | * | 11/1990 | Rezac et al. | 200/401 |
| 5,003,139 | A | * | 3/1991 | Edds et al. | 200/401 |
| 5,070,361 | A | * | 12/1991 | Magnon et al. | 335/172 |
| 5,075,657 | A | * | 12/1991 | Rezac et al. | 335/6 |
| 5,508,670 | A | * | 4/1996 | Mantzouridis et al. | 335/172 |
| 5,828,277 | A | * | 10/1998 | Duchemin | 335/132 |
| 5,912,605 | A | * | 6/1999 | Eberts | 335/16 |
| 5,929,405 | A | * | 7/1999 | Wehrli et al. | 200/50.01 |
| 5,931,290 | A | * | 8/1999 | Wehrli et al. | 200/400 |

(Continued)

FOREIGN PATENT DOCUMENTS

| | | | |
|---|---|---|---|
| EP | 2339600 | A1 | 6/2011 |
| WO | 0079664 | A1 | 12/2000 |

*Primary Examiner* — Shawki S Ismail
*Assistant Examiner* — Lisa Homza
(74) *Attorney, Agent, or Firm* — General Electric Company

(57) ABSTRACT

An override device is described for use with a coupler of a circuit breaker. The override device comprising a cam member coupled to the coupler. The cam member comprising a slot. The override device also including an actuator coupled to the cam member and configured to move the cam member between an over-current protection position and an over-current relay override position and a push member coupled to the coupler. The slot configured to guide the push member to a first position when the actuator moves the cam member to the over-current protection position. The slot further configured to guide the push member to a second position when the actuator moves the cam member to the over-current relay override position to permit current flow through the circuit breaker.

19 Claims, 11 Drawing Sheets

(56) References Cited

U.S. PATENT DOCUMENTS

| | | | | |
|---|---|---|---|---|
| 5,938,008 | A * | 8/1999 | Wehrli et al. | 200/400 |
| 5,973,278 | A * | 10/1999 | Wehrli et al. | 200/308 |
| 6,066,821 | A * | 5/2000 | Wehrli et al. | 200/552 |
| 6,072,136 | A * | 6/2000 | Wehrli et al. | 200/401 |
| 6,080,947 | A * | 6/2000 | Ulerich et al. | 200/308 |
| 6,204,743 | B1 | 3/2001 | Greenberg et al. | |
| 6,256,183 | B1 | 7/2001 | Mosesian | |
| 6,356,426 | B1 | 3/2002 | Dougherty | |
| 6,403,909 | B1 * | 6/2002 | Green et al. | 218/22 |
| 6,486,421 | B1 * | 11/2002 | Jones et al. | 200/50.32 |
| 6,570,749 | B1 | 5/2003 | Ling et al. | |
| 6,724,284 | B2 * | 4/2004 | Simms et al. | 335/14 |
| 6,738,246 | B1 | 5/2004 | Strumpler | |
| 7,115,830 | B1 * | 10/2006 | Weister et al. | 200/400 |
| 7,221,246 | B2 * | 5/2007 | Rajauria et al. | 335/16 |
| 7,746,624 | B2 | 6/2010 | Rispoli et al. | |
| 8,023,235 | B2 * | 9/2011 | Bilac et al. | 361/42 |
| 8,395,063 | B2 * | 3/2013 | Lagiewka et al. | 200/43.11 |
| 8,704,114 | B2 * | 4/2014 | Meyer-Haack | 200/50.32 |
| 2002/0105771 | A1 * | 8/2002 | Simms et al. | 361/115 |
| 2006/0152308 | A1 * | 7/2006 | Rajauria et al. | 335/16 |
| 2008/0042787 | A1 * | 2/2008 | McCoy | 335/186 |
| 2008/0135390 | A1 * | 6/2008 | McCoy | 200/331 |
| 2009/0109632 | A1 | 4/2009 | Rispoli et al. | |
| 2011/0163836 | A1 * | 7/2011 | Darr et al. | 337/143 |
| 2011/0163837 | A1 * | 7/2011 | Darr et al. | 337/186 |
| 2011/0169599 | A1 * | 7/2011 | Darr et al. | 337/143 |
| 2011/0193675 | A1 * | 8/2011 | Darr et al. | 337/187 |
| 2013/0192965 | A1 * | 8/2013 | Cieply et al. | 200/337 |

* cited by examiner

OVERRIDE DEVICE FOR A CIRCUIT BREAKER AND METHODS OF OPERATING CIRCUIT BREAKER

BACKGROUND OF THE INVENTION

The embodiments described herein relate generally to an override device for a circuit breaker, and more particularly, to methods and systems used to activate and de-activate over-current protection in the circuit breaker.

A circuit breaker is an automatically operated electrical switch designed to protect an electrical circuit from damage caused by overloaded or shorted circuits. A coupler mechanism of the circuit breaker can be actuated to open and close contacts to which a load is connected. Circuit breakers have an over-current trip unit that provides over-current protection. Conventional over-current trip units use a magnetic yoke that surrounds a current-carrying leader. The magnetic yoke has an anchor that is movable along an axis and a spring that applies a resistive force against movement of the anchor. Current flowing through the leader induces a magnetic force that causes the anchor to apply a force against the resistance of the spring. If the current flowing through the leader exceeds a pre-determined value, the magnetic force acting on the anchor is greater than the force of the spring. Thus, the anchor is pulled toward the magnet which actuates a coupler to interrupt or "trip" the circuit. Some applications may require an override of the over-current trip unit. In these situations, an override device is required to permit current flow through the circuit breaker when the current exceeds the pre-determined value.

BRIEF DESCRIPTION OF THE INVENTION

In one aspect, an override device is provided for use with a coupler of a circuit breaker. The override device including a cam member coupled to the coupler. The cam member including a slot. The override device also including an actuator coupled to the cam member and configured to move the cam member between an over-current protection position and an over-current relay override position and a push member coupled to the coupler. The slot configured to guide the push member to a first position when the actuator moves the cam member to the over-current protection position. The slot further configured to guide the push member to a second position when the actuator moves the cam member to the over-current relay override position to permit current flow through the circuit breaker.

In another aspect, a circuit breaker is provided that includes an over-current trip unit including a trip rod configured to move between a REST position and a TRIPPED position, a coupler removably coupled to the over-current trip unit, and a cam member coupled to the coupler. The over-current trip unit also including an actuator coupled to the cam member and configured to move the cam member between an over-current protection position and an over-current relay override position and a push member coupled to the coupler and to the cam member. The cam member configured to move the push member to a first position such that the trip rod remains spaced from the push member when the trip rod is in the TRIPPED position.

In a further aspect, a method of controlling current through a circuit breaker is provided. The method includes positioning a coupler a distance from an over-current trip unit, the over-current trip unit is configured to move between a REST position and a TRIPPED position. The method also includes moving a cam member from an over-current protection position to an over-current relay override position, wherein current is permitted to flow through the circuit breaker when the cam is in the over-current relay override position and the over-current trip unit is in the TRIPPED position.

DETAILED DESCRIPTION OF THE INVENTION

Figure 1:
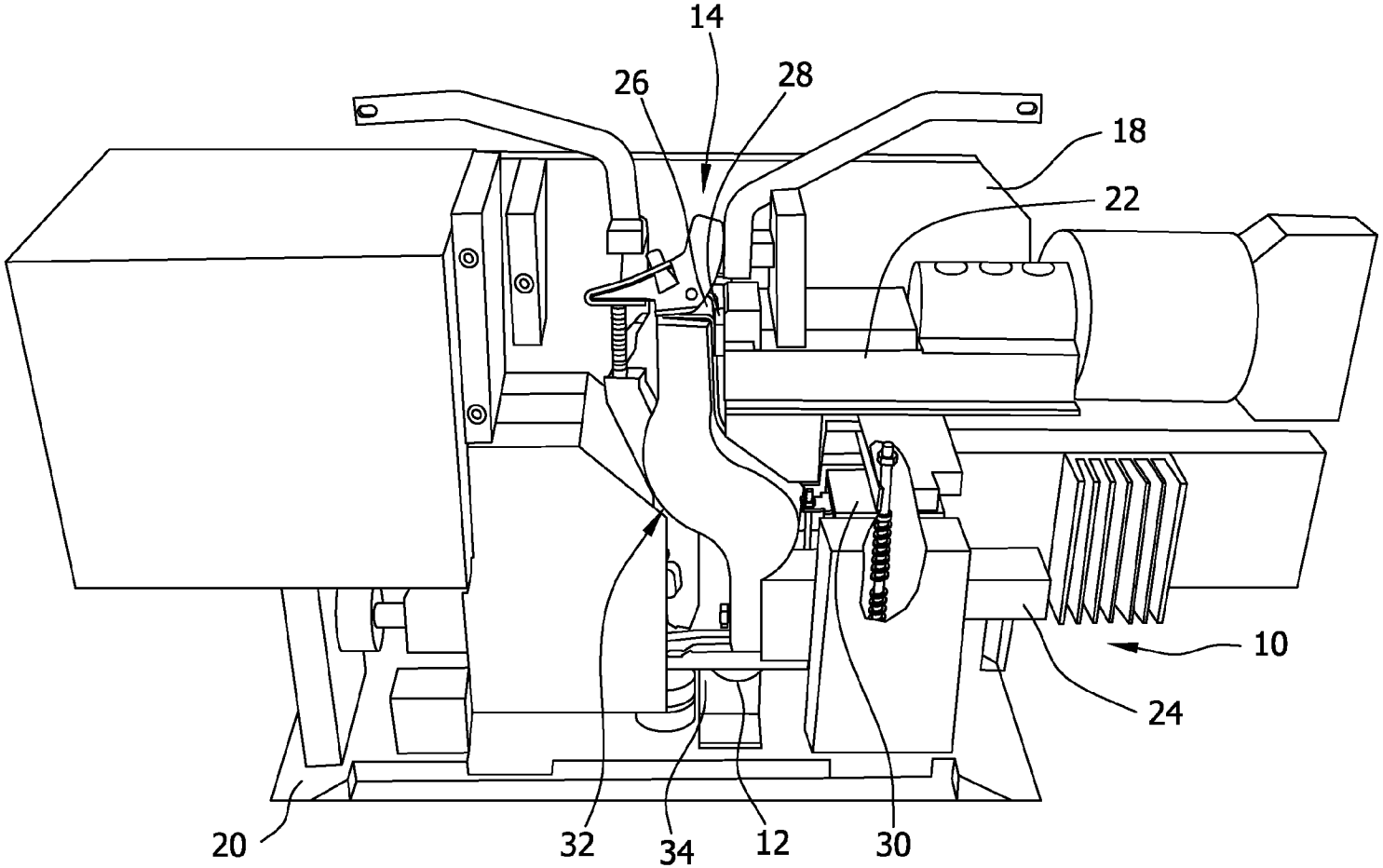
FIG. 1 illustrates a side view of a circuit breaker in a CLOSED position.
Figure 2:
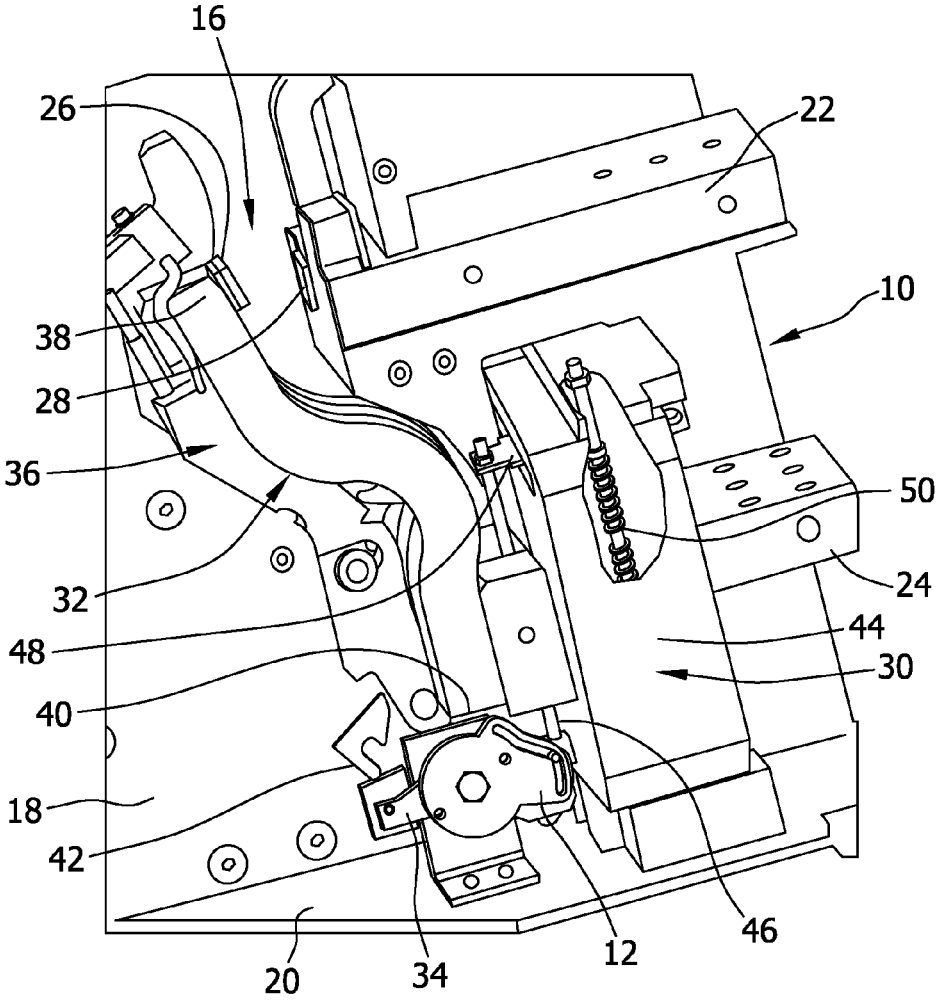
FIG. 2 illustrates a partial side view of the circuit breaker shown in FIG. 1 in an OPENED position and an override device.

FIG. 1 illustrates a side view of a circuit breaker 10 shown in a CLOSED position 14. FIG. 2 illustrates a partial side view of circuit breaker 10 shown in an OPENED position 16 and an override device 12. Circuit breaker 10 includes a housing 18 having a base 20 for mounting components thereon. Circuit breaker 10 further includes a first terminal 22, a second terminal 24, a movable contact 26, a stationary contact 28, an over-current trip unit 30, a flexible connection 32 and a coupler 34.

In use, current enters circuit breaker 10 through one of terminals 22 and 24 and exits circuit breaker 10 through the other of terminals 22 and 24. The current also passes through movable contact 26 and stationary contact 28. When circuit breaker 10 is in CLOSED position 14, current flows unrestricted through circuit breaker 10 and, therefore, through an electrical device or circuit (not shown) that circuit breaker 10 is designed to protect. When circuit breaker 10 is in OPENED position 16, current flow is interrupted through circuit breaker 10 and, consequently, through the electrical device or circuit that circuit breaker 10 is designed to protect.

During the presence of a higher current value than the assigned current for circuit breaker 10, over a specified period of time, circuit breaker 10 moves to OPENED position 16. The exposure of circuit breaker 10 to the higher current value activates over-current trip unit 30 which causes coupler 34 to release a latch 42 and to facilitate movement of a lever arm 36 with flexible connection 32 to interrupt the current flow through circuit breaker 10.

Movable contact 26 is coupled to and carried by flexible connection 32 on lever arm 36 and stationary contact 28 is coupled to first terminal 22. Contact 26 is movable between CLOSED position 14 and OPENED position 16 with respect to first terminal 22. Movable contact 26 is coupled to stationary contact 28 in CLOSED position 14, and movable contact 26 is de-coupled from stationary contact 28 in OPENED position 16.

Flexible connection 32 is configured to electrically connect terminals 22 and 24. Flexible connection 32 is mounted on lever arm 36 and is rotatably coupled to base 20. Flexible connection 32 includes a first end 38 coupled to movable contact 26 and a second end 40 coupled to second terminal 24. Lever arm 36 is configured to rotate movable contact 26 between CLOSED position 14 and OPENED position 16 with respect to first terminal 22. Second end 40 remains coupled to second terminal 24 as first end 38 rotates movable contact 26. Latch 42 is coupled to lever arm 36 and is configured to release lever arm 36 when acted upon by coupler 34 as described herein.

Over-current trip unit 30 is coupled to second terminal 24 and is configured to detect current from second terminal 24. When current exceeds a pre-determined value, i.e., an over current event, over-current trip unit 30 interrupts or breaks current flow through circuit breaker 10. Over-current trip unit 30 includes a magnetic yoke 44, a trip rod 46, an anchor 48, and a spring 50. Trip rod 46 is positioned perpendicular to magnetic yoke 44 and is coupled to anchor 48.

Spring 50 is configured to resist downward movement of anchor 48. As current flows through terminals 22 and 24, a magnetic flux is created within magnetic yoke 44 that attracts anchor 48 against the force of spring 50. Movement of anchor 48 causes trip rod 46 to move and to contact and push coupler 34.

Figure 3:
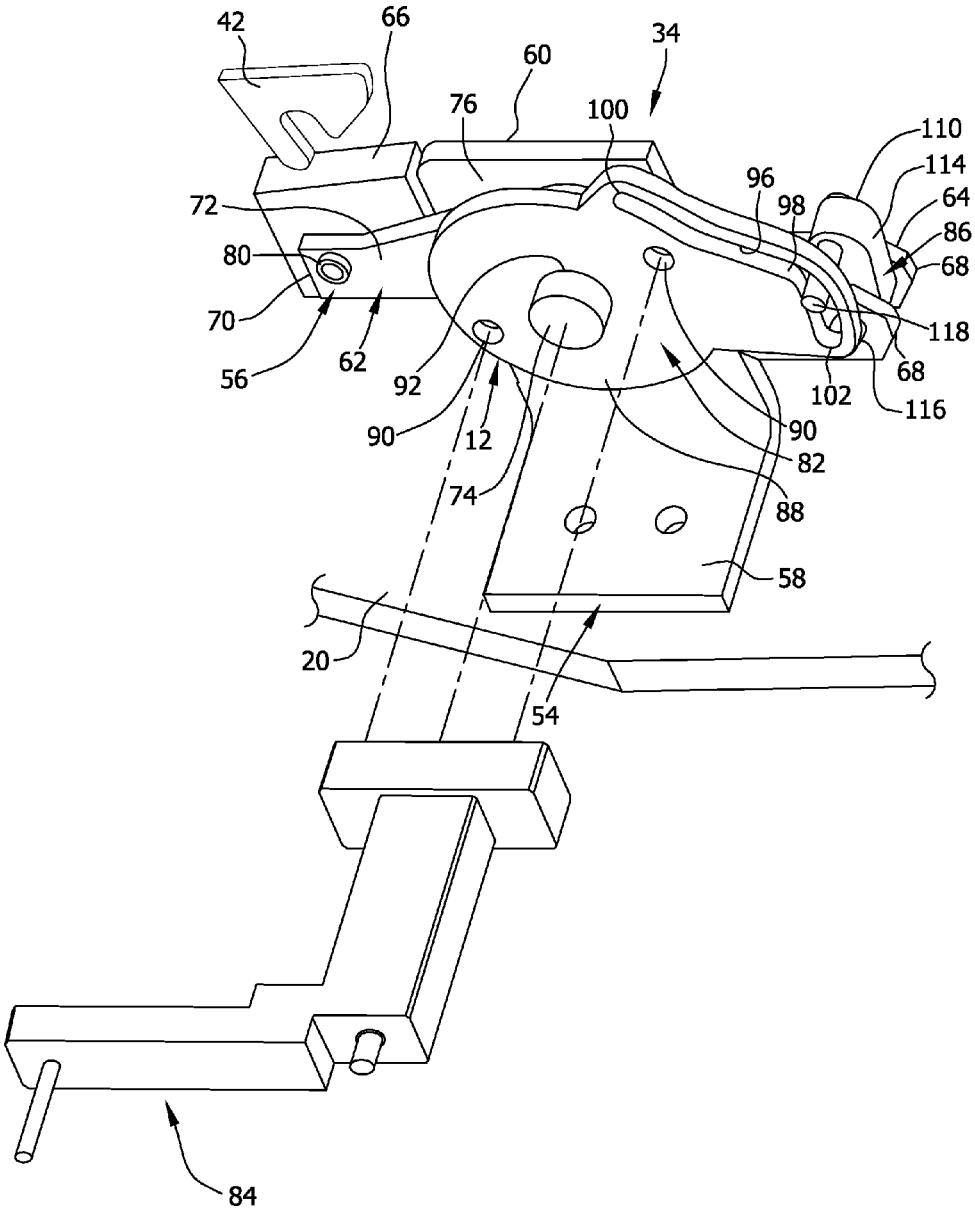
FIG. 3 illustrates a front view of the override device shown in FIG. 2 coupled to a coupler of the circuit breaker.
Figure 4:
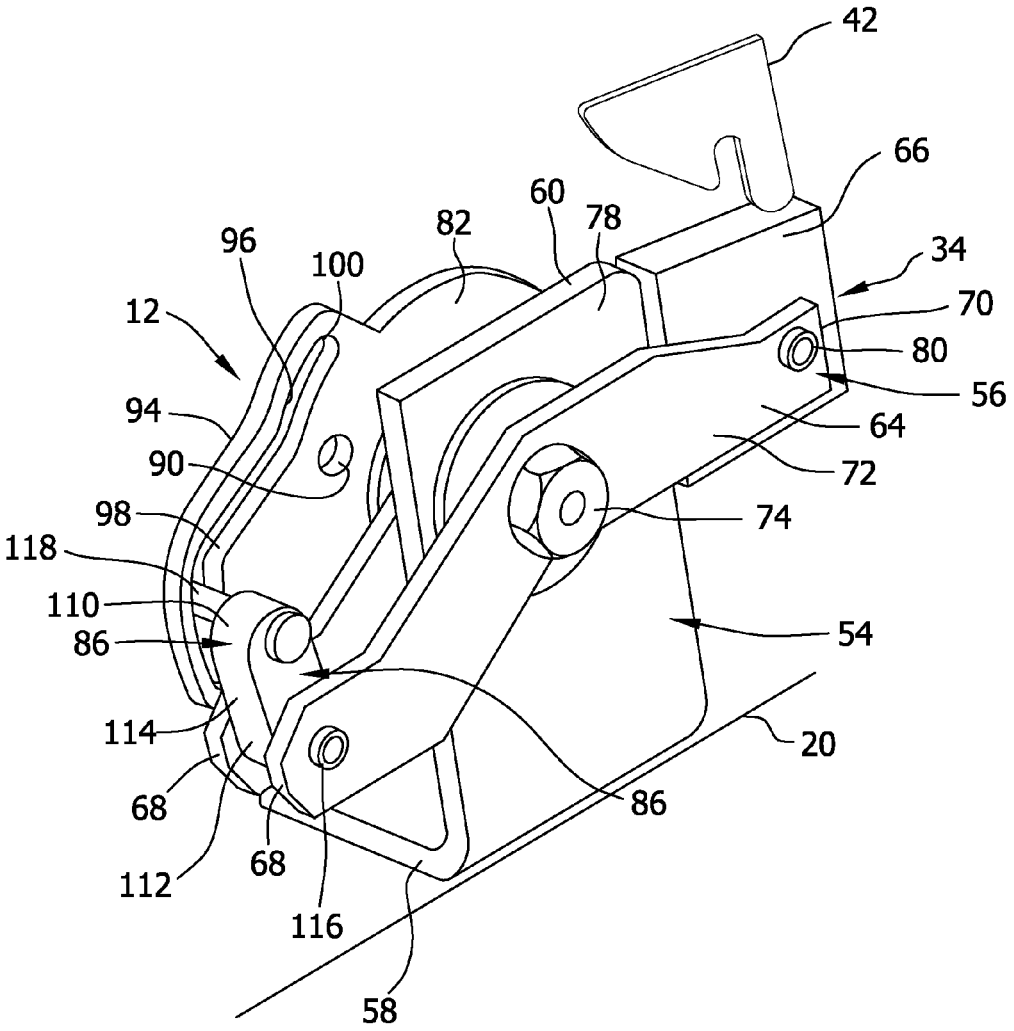
FIG. 4 illustrates a rear view of the override device and coupler shown in FIG. 3.

FIG. 3 illustrates a front view of override device 12 coupled to coupler 34. FIG. 4 illustrates a rear view of override device 12 and coupler 34. Coupler 34 is configured to rotate latch 42 when acted upon by trip rod 46 (shown in FIG. 2) as described herein. Coupler 34 includes a flange 54 and a rocker assembly 56 rotatably coupled to flange 54. Flange 54 includes a first leg 58 which is configured to couple to base 20 and a second leg 60 extending substantially perpendicular from first leg 58.

Rocker assembly 56 includes a front link 62, a rear link 64, and a trip block 66. Each link 62 and 64 has opposing ends 68 and 70, and a body 72 therebetween. A pivot pin 74 rotatably couples front link 62 to a front side 76 of second leg 60 and rotatably couples rear link 64 to a rear side 78 of second leg 60. A coupling pin 80 couples trip block 66 to ends 70 of links 62 and 64. In the exemplary embodiment, trip block 66 is coupled between links 62 and 64. Links 62, 64 are configured to move trip block 66 up and down with respect to flange 54. When links 62 and 64 move trip block 66 upward, trip block 66 is configured to contact and rotate carrier latch 42.

Override device 12 includes a cam member 82, an actuator 84 and a push member 86. Cam member 82 includes a body 88 having a pair of pin apertures 90 and a fastener aperture 92 which extend through body 88. Body 88 further includes a slot 96 extending at least partially therethrough. In one embodiment, slot 96 extends entirely through body 88. Slot 96 includes a first portion 98, a second portion 100 and a third portion 102. In one embodiment, second portion 100 is angled in a first direction with respect to first portion 98 and third portion 102 is angled in a second direction with respect to first portion 98 that is opposite the first direction.

Push member 86 is spaced from trip rod 46 (shown in FIG. 2) and is configured to rotatably couple to coupler 34. In one embodiment, push member 86 is configured to have two positions. In the first position, trip rod 46 contacts push member 86 during an over current event to activate coupler 34. In the second position, push member 86 remains spaced from trip rod 46 in an over current event such that coupler 34 is not activated during the over current event. Push member 86 includes a first end 110, a second end 112 and a body 114 therebetween. A pivot pin 116 rotatably couples second end 112 to link ends 68 of coupler 34. Push member 86 is configured to rotate about pivot pin 116 and between link ends 68. Push member 86 further includes a drive pin 118 coupled to first end 110 and extending outward toward cam member 82. In one embodiment, drive pin 118 extends through slot 96. In an alternative embodiment, drive pin 118 extends at least partially into slot 96.

Figure 5:
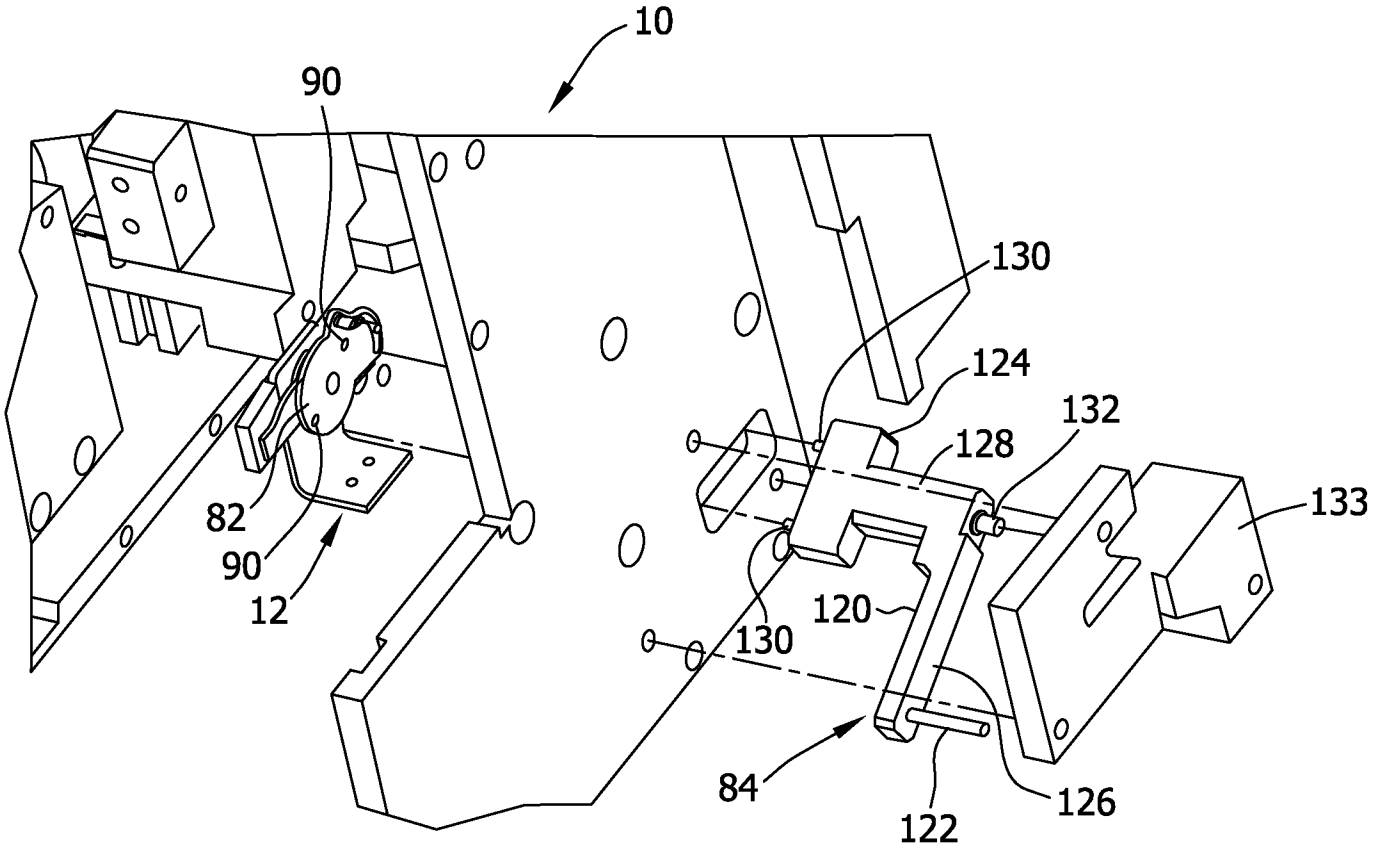
FIG. 5 illustrates a perspective, exploded view of components of the override device shown in FIG. 3.
Figure 6:
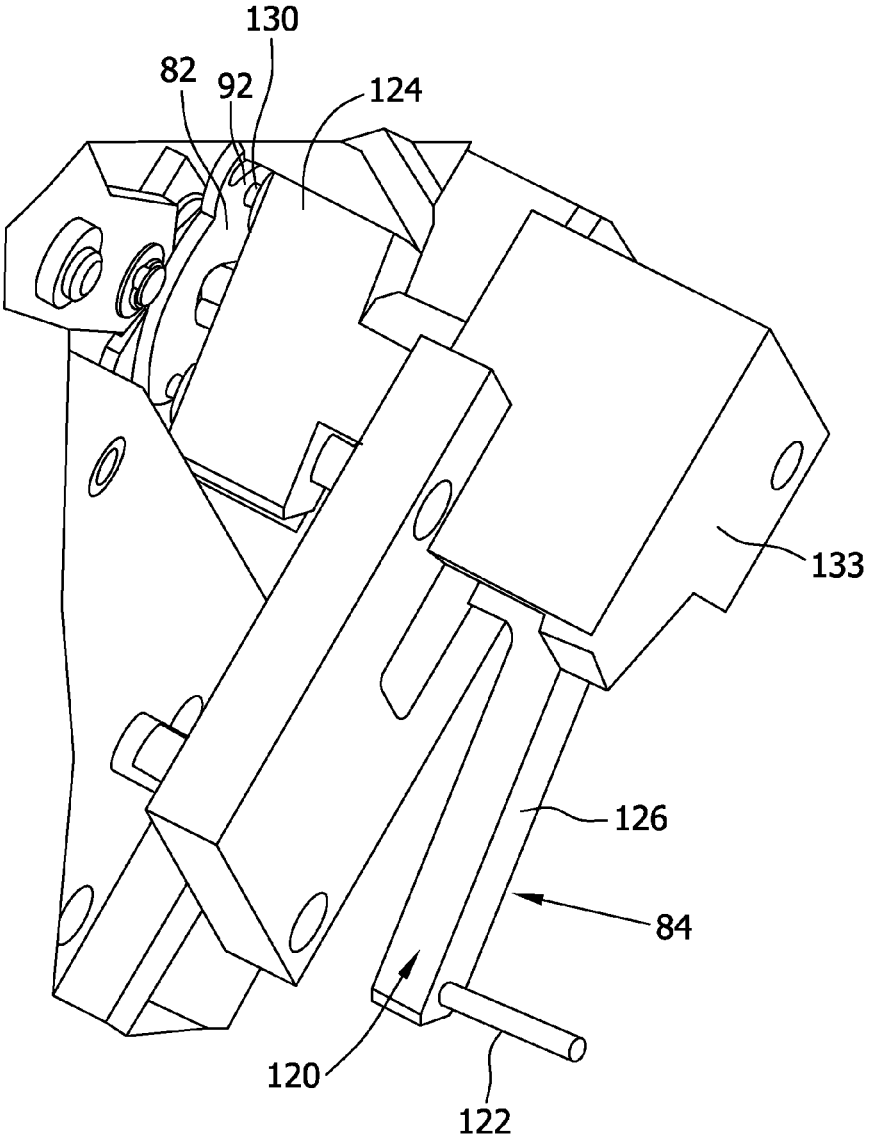
FIG. 6 illustrates a perspective view of components of the override device shown in FIG. 5 assembled to the circuit breaker.

FIG. 5 illustrates a perspective, exploded view of components of override device 12. FIG. 6 illustrates a perspective view of components of override device 12 shown in FIG. 5 assembled to circuit breaker 10. Actuator 84 is configured to couple with cam member 82 at pin apertures 90. When acted upon by a force, actuator 84 is configured to reciprocally move cam member 82. As illustrated, actuator 84 includes a lever 120, a handle 122, and a coupler member 124. Lever 120 has a first portion 126 and a second portion 128. Handle 122 couples to first portion 126 and coupler member 124 couples to second portion 128. A pair of coupling pins 130 extend outward from coupler member 124 and extend into apertures 90. A pivot pin 132 extends from lever 120 proximate the intersection of first portion 126 and second portion 128 and couples to a protective housing 133. In one embodiment, actuator 84 includes an electrically driven device (not shown).

Figure 7:
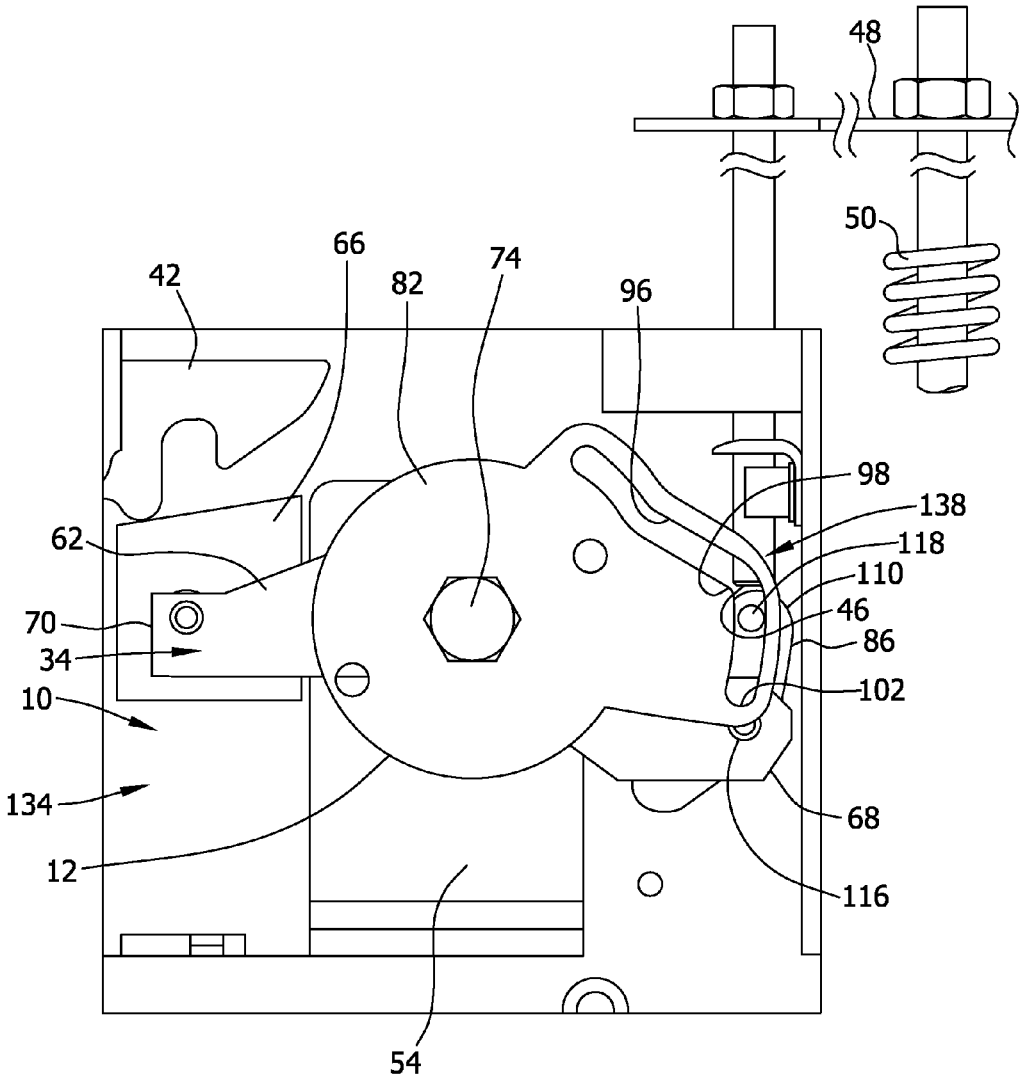
FIG. 7 illustrates a front view of the override device shown in FIG. 3 coupled to the coupler of the circuit breaker and in an over-current protection position.

FIG. 7 is a front view of override device 12 coupled to coupler 34. Override device 12 is shown in an over-current protection position 134 that facilitates interrupting or breaking current flow through circuit breaker 10 when current through override device 12 exceeds a pre-determined value, i.e., during an over current event.

To position circuit breaker 10 in over-current protection position 134, a user moves handle 122 and rotates lever 120 (shown in FIGS. 5 and 6) which rotates cam member 82 to over-current protection position 134. In over-current protection position 134, push member 86 is positioned such that end 110 is spaced from trip rod 46 and drive pin 118 extends within slot 96 at slot third portion 102. As shown in FIG. 7, trip rod 46 is positioned in a REST position 138 that is spaced away from push member 86.

Figure 8:
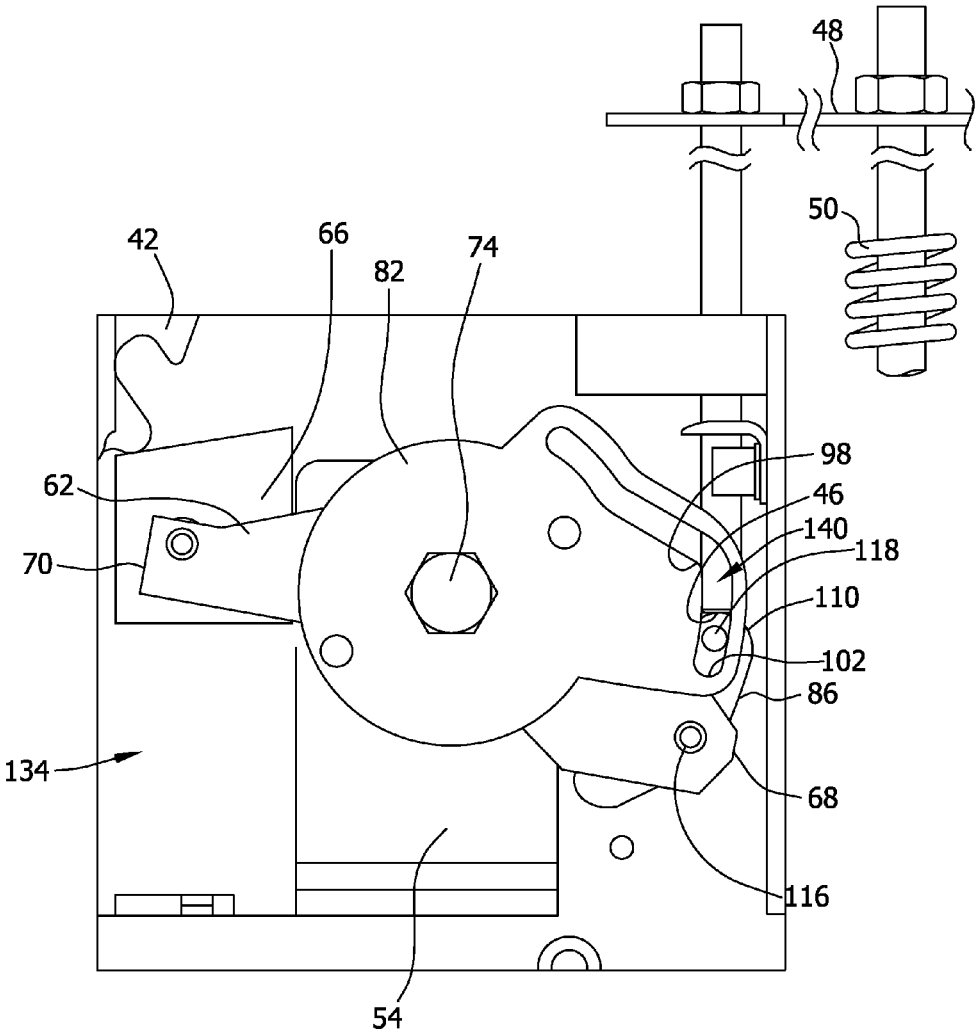
FIG. 8 illustrates another front view of the override device shown in FIG. 3 coupled to the coupler and in the over-current protection position.

FIG. 8 is another front view of override device 12 shown in over-current protection position 134 with trip rod 46 positioned in the TRIPPED position. When current flowing through circuit breaker 10 exceeds a pre-determined value, trip rod 46 moves from REST position 138 to a TRIPPED position 140. During this movement, trip rod 46 contacts push member end 110 and moves push member 86. In response, links 62 and 64 rotate about pivot pin 74 with respect to coupler flange 54. In the exemplary embodiment, link ends 70 rotate in a first direction about pivot pin 74 and link ends 68 rotate in a second, opposite direction about pivot pin 74 while drive pin 118 moves within slot third portion 102. By moving within slot third portion 102, drive pin 118 prevents cam member 82 from moving out of over-current protection position 134 and maintains circuit breaker 10 in OPENED position 16 (shown in FIG. 2).

Link ends 70 rotate about pivot pin 74 to move trip block 66 toward carrier latch 42 and rotates carrier latch 42 to release and thus enable rotation of lever arm 36. Lever arm 36 rotates movable contact 26 (shown in FIG. 2) away from first terminal 22 (shown in FIG. 2) and positions circuit breaker 10 in OPENED position 16 (shown in FIG. 2).

Figure 9:
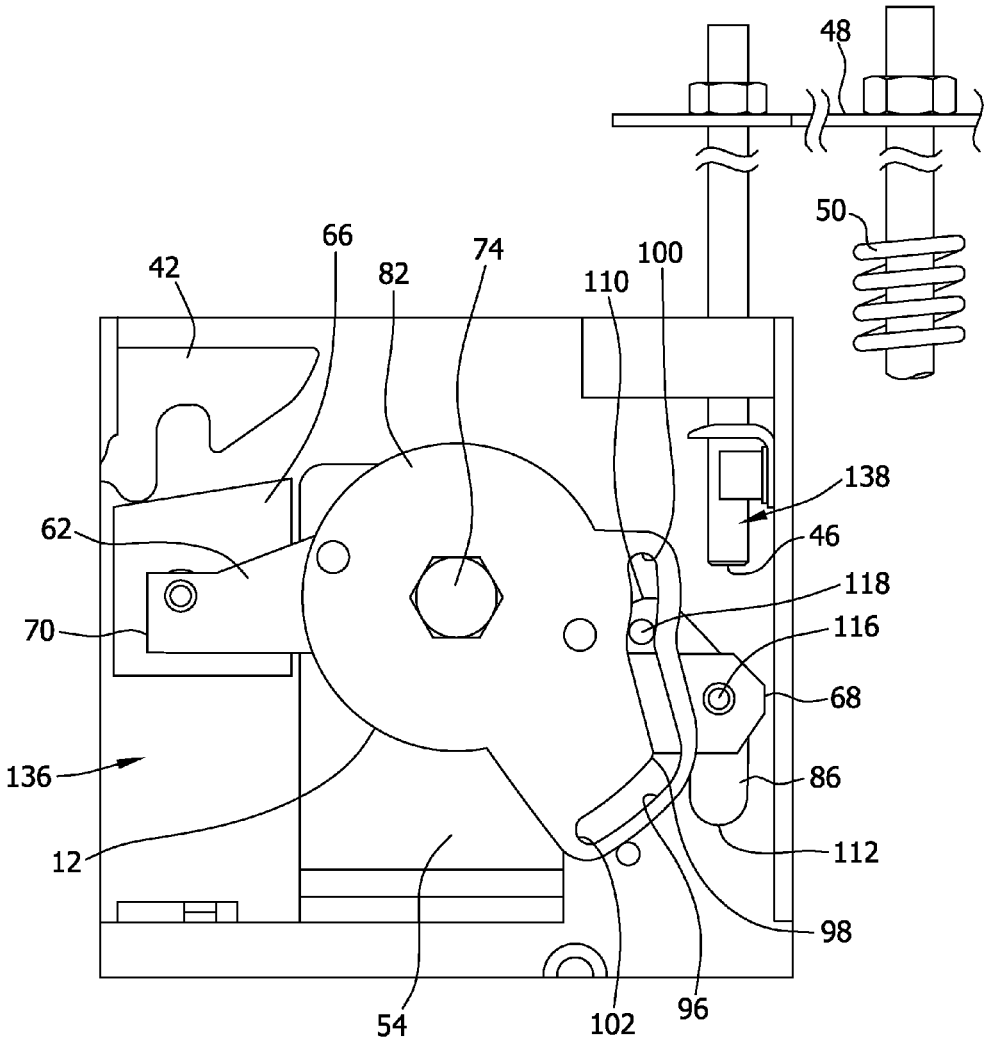
FIG. 9 illustrates a front view of the override device shown in FIG. 3 coupled to the coupler and in an over-current relay override position.
Figure 10:
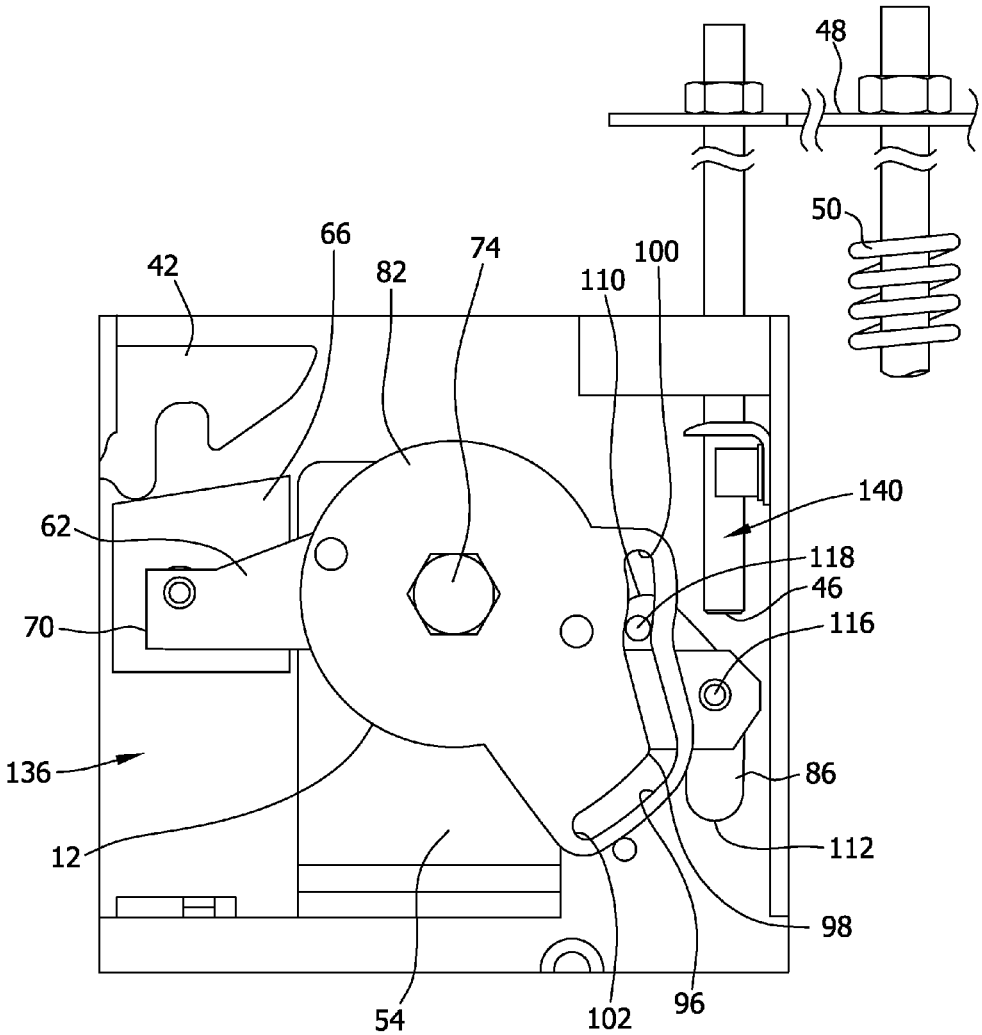
FIG. 10 illustrates another front view of the override device shown in FIG. 3 coupled to the coupler and in the over-current relay override position.

FIGS. 9 and 10 are front views of override device 12 in over-current relay override position 136. FIG. 9 illustrates trip rod 46 in REST position 138 and FIG. 10 illustrates trip rod 46 in TRIPPED position 140. Override position 136 permits current flow through circuit breaker 10 during an over current event and trip rod 46 is moved from REST position 138 to TRIPPED position 140.

To position circuit breaker 10 in over-current relay override position 136, a user moves handle 122 and rotates lever 120 (shown in FIGS. 5 and 6) which rotates cam member 82 to over-current relay override position 136. Rotation of cam member 82 moves slot 96. In the exemplary embodiment, slot 96 guides drive pin 118 away from slot third portion 102, through slot first portion 98 and to slot second portion 100. Slot first portion 98 is sized and shaped to guide drive pin 118 to slot second portion 100 upon rotation of lever 120. Drive pin 118 rotates push member 86 about pivot pin 116 and away from trip rod 46.

As shown in FIG. 10, when trip rod 46 moves to TRIPPED position 140, trip rod 46 does not contact push member 86. Consequently, push member 86 does not actuate coupler 34 and current continues to flow through circuit breaker 10 even though current exceeds the pre-determined trip value.

Figure 11:
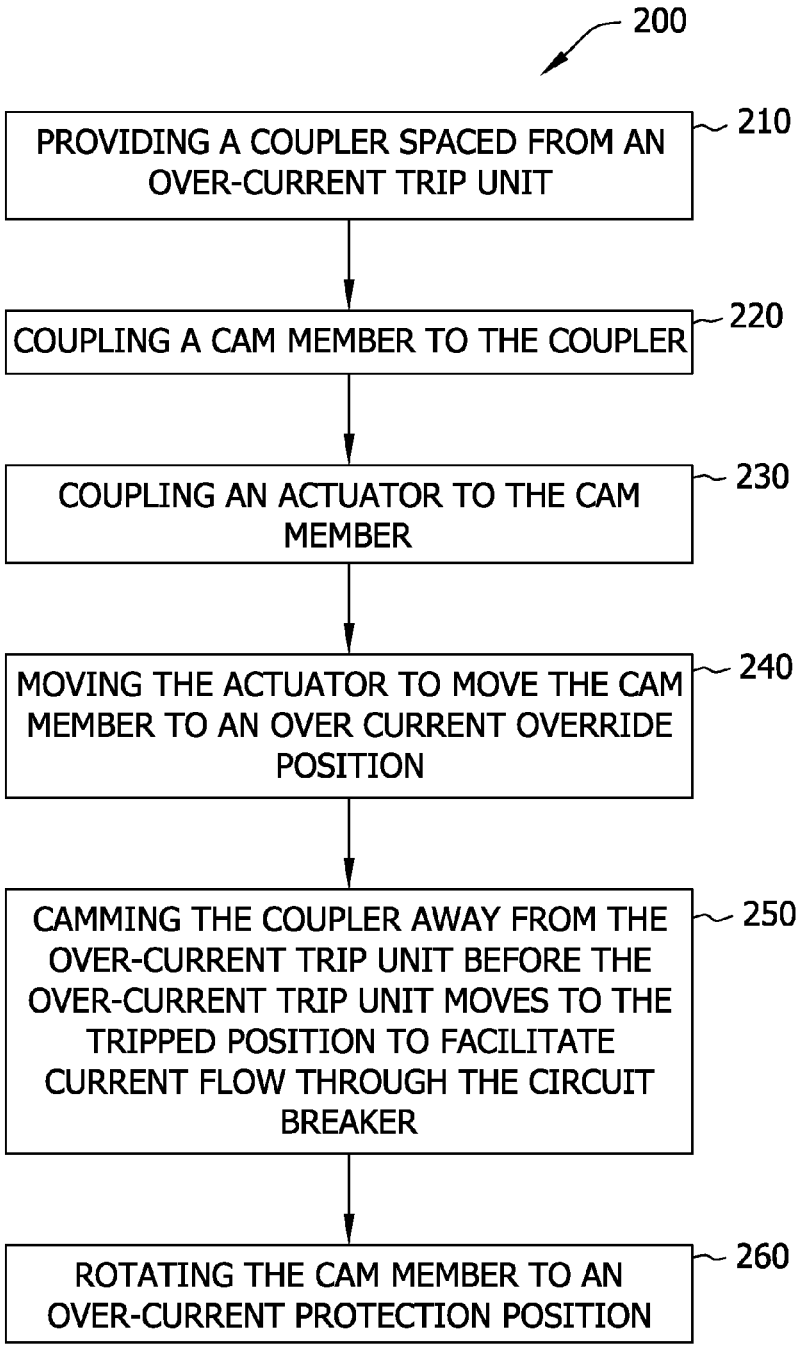
FIG. 11 is an exemplary flowchart illustrating a method of controlling current through the circuit breaker shown in FIG. 1.

FIG. 11 is an exemplary flowchart 200 illustrating a method of controlling current through a circuit breaker, for example circuit breaker 10 (shown in FIG. 1) by an override device, such as override device 12 (shown in FIG. 2). The method includes positioning 210 a coupler, such as coupler 34 (shown in FIG. 2), in a spaced position from an over-current trip unit, for example over-current trip unit 30 (shown in FIG. 2). The over-current trip unit is configured to move between a REST position and a TRIPPED position. A cam member, such as cam member 82 (shown in FIG. 3), is coupled 220 to the coupler. The method also includes coupling 230 an actuator, for example actuator 84 (shown in FIG. 3), to the cam member. The actuator is moved 240 to rotate the cam member to a over-current relay override position, for example over-current relay override position 136 (shown in FIGS. 9 and 10). The coupler is rotated or cammed 250 away from the over-current trip unit before the over-current trip unit moves to the TRIPPED position to permit current flow through the circuit breaker even during an over current event. The method also includes rotating 260 the cam member to an over-current protection position, such as over-current protection position 134 (shown in FIGS. 7 and 8) and rotating the coupler toward the over-current trip unit to interrupt or prevent current flow through the circuit breaker during an over current event.

The embodiments described herein provide a over-current relay override device for a circuit breaker. The override device can be used for new manufacture of circuit breakers or can be retro-fit with existing circuit breakers. In one embodiment, the override device includes a cam member configured to move between an over-current protection position and an over-current relay override position. The cam member reciprocates between the over-current protection position and the over-current relay override position to facilitate current flow through the circuit breaker when the circuit breaker is in a CLOSED position and an OPENED position. The override device provides effective circuit breaker designs to override any current controller to facilitate current flow when current exceeds a pre-determined value.

A technical effect of the system described herein is that the override device includes a cam member configured to move between an over-current protection position and an over-current relay override position. A further technical effect is that the cam member reciprocates between the over-current protection position and the override position to facilitate current flow through the circuit breaker when current exceeds a pre-determined value.

Exemplary embodiments of the override device and methods of controlling current flow are described above in detail. The override device and methods are not limited to the specific embodiments described herein, but rather, components of the override device and/or the circuit breaker and/or steps of the method may be utilized independently and separately from other components and/or steps described herein. For example, the override device and methods may also be used in combination with other electrical systems and methods, and are not limited to practice with only the circuit breaker as described herein.

Although specific features of various embodiments of the invention may be shown in some drawings and not in others, this is for convenience only. In accordance with the principles of the invention, any feature of a drawing may be referenced and/or claimed in combination with any feature of any other drawing.

This written description uses examples to disclose the invention, including the best mode, and also to enable any person skilled in the art to practice the invention, including making and using any layers or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. An override device for use with a coupler of a circuit breaker, said override device comprising:

a cam member coupled to the coupler and comprising a slot;

an actuator coupled to said cam member and configured to move said cam member between an over-current protection position and an over-current relay override position; and a push member coupled to the coupler, said slot configured to guide said push member to a first position when said actuator moves said cam member to the over-current protection position, said slot further configured to guide said push member to a second position when said actuator moves said cam member to the over-current relay override position to permit current flow through the circuit breaker when an amount of current exceeds a pre-determined trip value.

2. The override device of claim 1, wherein said push member comprises an end rotatably coupled to the coupler.

3. The override device of claim 1, wherein said push member comprises a drive pin disposed in said slot.

4. The override device of claim 1, wherein said slot comprises a first portion, a second portion, and a third portion, said second portion configured to maintain said push member in the first position, said third portion configured to maintain said push member in the second position.

5. The override device of claim 4, wherein said first portion is configured to guide said push member from the first position to the second position.

6. The override device of claim 4, wherein said slot second portion is angled away from said slot first portion and said slot third portion is angled away from said slot first portion.

7. The override device of claim 1, wherein the circuit breaker includes a trip rod, said push member configured to be moved by the trip rod during an over current event when the push member is in the first position.

8. The override device of claim 1, wherein the circuit breaker includes a trip rod, said push member configured to remain spaced from the trip rod during an over current event when the push member is in the second position to allow current to flow through the circuit breaker during the over current event.

9. A circuit breaker configured to be used with an over-current trip unit having a trip rod configured to move between a REST position and a TRIPPED position, said circuit breaker comprising:

a coupler configured to be removably coupled to the over-current trip unit;

a cam member coupled to said coupler;

an actuator coupled to said cam member and configured to move said cam member between an over-current protection position and an over-current relay override position; and a push member coupled to said coupler and to said cam member, said cam member configured to move said push member to a first position, when said actuator moves said cam member to the over-current relay override position, such that the trip rod remains spaced from said push member when the trip rod is in the TRIPPED position to permit current flow through the circuit breaker when an amount of current exceeds a predetermined trip value.

10. The circuit breaker of claim 9, wherein said cam member is further configured to move said push member to a second position such that the trip rod moves said push member when the trip rod is in the TRIPPED position.

11. The circuit breaker of claim 10, wherein said cam member comprises a slot configured to guide said push member from the first position to the second position.

12. The circuit breaker of claim 11, wherein said slot comprises a first portion, a second portion, and a third portion, said second portion configured to maintain said push member in the first position, said third portion configured to maintain said push member in the second position.

13. The circuit breaker of claim 12, wherein said first portion is configured to guide said push member from the first position to the second position.

14. The circuit breaker of claim 11, wherein said push member comprises a drive pin disposed in said slot.

15. A method of controlling current through a circuit breaker, the method comprising:

positioning a coupler a distance from an over-current trip unit, the over-current trip unit configured to move between a REST position and a TRIPPED position; and moving a cam member from an over-current protection position to an over-current relay override position, wherein current is permitted to flow through the circuit breaker when an amount of current exceeds a predetermined trip value and the cam is in the over-current relay override position and the over-current trip unit is in the TRIPPED position.

16. The method of claim 15, wherein a push member is configured to be moved by the cam member from a first position to a second position as the cam member moves from the over-current protection position to the over-current relay override position.

17. The method of claim 16, further comprising moving the cam member to the over-current protection position.

18. The method of claim 16 wherein the push member is configured to be moved by the cam member from the second position to the first position as the cam member moves from the over-current relay override position to the over-current protection position.

19. The method of claim 16 wherein moving a cam member comprises rotating a lever from a first position to a second position.

* * * * *